US005110415A

United States Patent [19]

Boucher et al.

[11] Patent Number: 5,110,415

[45] Date of Patent: May 5, 1992

[54] COMPOSITE DOCTOR BLADE ASSEMBLY FOR PULP OR PAPERMAKING MACHINE DOCTORS

[75] Inventors: Normand Boucher, Laval, Canada; Giancesare Bonetti, Milan, Italy

[73] Assignee: Albany International Corp., Menands, N.Y.

[21] Appl. No.: 512,851

[22] Filed: Apr. 23, 1990

[51] Int. Cl.[5] ..... D21G 3/00; D21G 3/02; D21G 3/04

[52] U.S. Cl. ..... 162/281; 162/272; 15/256.51; 101/425; 118/261

[58] Field of Search ..... 162/272, 281, 199, 280; 15/256.51; 101/162, 425; 118/261, 652; 100/174

[56] References Cited

U.S. PATENT DOCUMENTS

| | | | |
|---|---|---|---|
| 2,077,816 | 4/1937 | Vickery | 15/256.51 |
| 3,163,878 | 1/1965 | Smith et al. | 15/256.51 |
| 3,356,067 | 12/1967 | Krasnow et al. | 118/261 |
| 3,778,861 | 12/1973 | Goodnow | 162/281 |
| 4,141,112 | 2/1979 | Klemz | 162/281 |
| 4,367,120 | 1/1983 | Hendrikz | 162/281 |
| 4,549,933 | 10/1985 | Judd et al. | 162/281 |

*Primary Examiner*—Richard V. Fisher
*Assistant Examiner*—Todd J. Burns
*Attorney, Agent, or Firm*—Kane, Dalsimer, Sullivan, Kurucz, Levy, Eisele & Richard

[57] ABSTRACT

A doctor blade is made from an elongated strip of reinforced composite material which material forms fibrillated protrusions when cut. A plurality of cuts are made in the material which form recesses or tabs. The recesses are offset to increase the effective thickness of the strip so that it can be inserted longitudinally or transversely into a doctor blade holder. The fibrillated protrusions maintain the recesses in an offset position.

17 Claims, 6 Drawing Sheets

10
12
14
16
16
16
16

30

25
30

22
24
VI
VI
30
30
30
30
26
20
32

34
36
40
26

30
38

COMPOSITE DOCTOR BLADE ASSEMBLY FOR PULP OR PAPERMAKING MACHINE DOCTORS

BACKGROUND OF THE INVENTION a. Field of Invention

This invention pertains to a blade used on a doctor for a pulp or papermaking machine, and more particularly to a blade made of a fiber enforced composite material.

Pulp or papermaking machines, utilize machine rolls. Such machine rolls are used during various aspects of the process, for example, in the forming, pressing, drying or calendering sections. The operation of machine rolls requires a device to remove contaminants which form on the roll surface and/or to peel off a sheet or web from the rolls. A traditional method of achieving this is through the use of a mechanical device commonly referred to as a doctor or doctor blade. The failure to remove the contaminants or the sheet effectively can have a catastrophic effect on the quality of the product being produced.

The doctor blade is typically fastened to a structural beam which is adjustably supported across the papermaking machine on which a blade holder and a replaceable blade is provided. The doctor blade comes in direct contact with the roll surface so as to scrape off any contaminants from the roll surface including the whole pulp or paper web sheet or parts thereof.

b. Description of the Prior Art

There is a plurality of different doctor blade types having dimensions and materials commonly available in the industry, as well as different designs of blade holders. Laminated plastic doctor blades and blade holders such as type KF-35, KF-35A or PNEUFLEX blade holder are manufactured by Albany International Corporation, the assignee of the present invention. For obvious reasons the blade should be securely attached to the blade holder as a doctor without a blade will not scrape anything from the roll, and as aforesaid, this will have a catastrophic effect on the machine production. But even worst, the blade or a part thereof can come off and fall in the process where it will irreparably damage the pulp or paper machine clothing, and possibly the roll, because of direct and sudden contact with the blade holder.

The ultimate solution to prevent the aforesaid catastrophic situation would be to permanently fasten the blade to the holder or to make it as an integral part of the holder. But, doctor blades do wear with time. Depending on the application, they can last anywhere from a few hours to several months. Therefore, a doctor blade must be a replaceable item. The blade and holder design should allow for easy, fast and safe blade replacement so as to insure that neither the blade or part thereof, like the fastening devices for example, will come off and fall into the process.

A common design in the industry is to put along one edge of the blade, some types of rivets, or some other mechanical retainers that could be, for example, rivetted, glued, or press-fitted to the blade. The holder is then manufactured with a slot incorporating a step or a groove. The edge of the blade with the retainers can be slid into the groove through one end of the holder. Alternative designs are also available which allow a blade to be removed from the front of the holder, for the few applications where the access through the ends is limited. However, all these designs although widely used in the industry have a significant drawback as very often a retainer will come off the blade, and will either fall into the process, or will stay in the holder but become wedged into the blade slot, thus making the blade very difficult to slide in or out.

Another design used in the industry consist of making the blade with built-in retainers whereby there is no mechanically fastened part on the blade that can come off. One known way to do this is to machine the blade out of thicker material, leaving a narrow step along one edge that will retain the blade in the holder slot. This method is widely used to manufacture polyethylene doctor blades, where machining is fast and easy, and where thicker material is also required to add strength or to increase wear life. Theoretically, this method can be used to manufacture blades out of other popular materials, like metal or laminated plastic. However, the extended cost of the material and machining time combined with the high amount of tooling required, render this method simply undesirable. Moreover, it would not be suitable for the front removable blade design.

Another known way of making built-in retainers to the doctor blade is to stamp or punch pairs of short recesses along one edge of the blade at a certain spacing, to simulate the function of the rivets of the first design. A typical drawing of the industry standard is shown in FIGS. 1 and 2. However, this design has been used only to manufacture metallic doctor blades, such as bronze or stainless steel for example. It was believed that the mechanical properties of synthetic material used in the doctor blade industry, those of laminated glass fiber reinforced plastic, for example, did not allow this method to be used on plastic blades. All the laminated composite doctor blades known to be used on the pulp or paper machines today, are manufactured with add-on retainers that are either rivetted, glued, or press-fitted along one edge of the blade, a design with major disadvantages as described above. One such prior art rivetted composite doctor blade is shown in FIG. 3.

OBJECTIVES AND SUMMARY OF THE INVENTION

It is therefore a principle objective of the invention to provide a laminated plastic doctor blade with built-in retainers, thereby offering all the advantages relating to this design yet cost effective to manufacture.

A blade is made in accordance with this invention by taking an elongated strip of reinforced composite material and punching a plurality of elongated recesses adjacent to a longitudinal side of the material. The recesses are formed by making cuts which are made long enough so that the plastic or permanent deformation of the material in the region around each recess is avoided. The cuts are made by a method which fibrillates the material along the plane of the cut so that irregularities are formed in the material along the cut which prevent the recessed material from returning to a normal position.

DETAILED DESCRIPTION OF THE INVENTION

Figures 1, 2, 4, 4A, 4B, 5, 6:
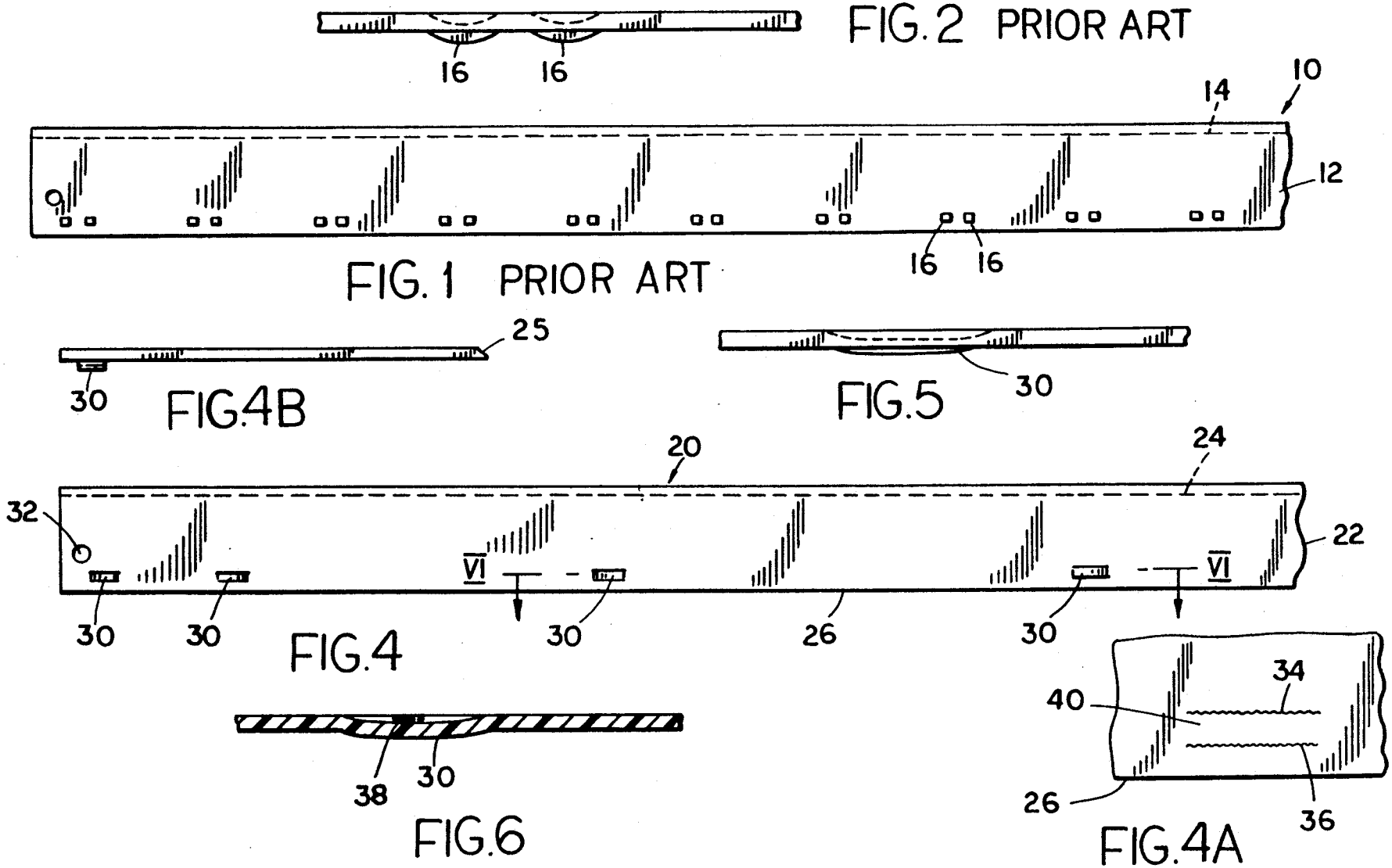
FIG. 2 PRIOR ART
FIG. 1 PRIOR ART
FIG. 1 shows a plan view of a prior art metallic doctor blade discussed above.
FIG. 2 shows a partial side view of the prior art doctor blade of FIG. 1.
FIG. 4 shows a plan view of a plastic laminated doctor blade constructed in accordance with this invention.
FIG. 4A shows an enlarged partial plan view of the blade of FIG. 4.
FIG. 4B shows an end view of the doctor blade of FIG. 4.
FIG. 5 shows a partial side view of the doctor blade of FIGS. 4, 4A, 4B.
FIG. 6 shows a partial sectional view taken along line VI—VI in FIG. 4.

Referring to FIGS. 1 and 2, one known doctor blade 10 consists of an elongated strip 12 made of stainless steel, bronze, or other alloys. One longitudinal side 14, strip 12 is beveled to form an edge. Along the opposite side, strip 12 is provided with a plurality of short punchings 16 punched into the member 12. Preferably, punchings 16 are formed in pairs as shown, and each punching is about ⅜" (9.5 mm) long. These punchings are made by permanently or plastically elongating and deforming the material of the strip to form the shown structure. This process could not be used on a reinforced composite blade because such materials are fragile and when they are punched they do not deform plastically, but rather they break quickly.

Figure 3:
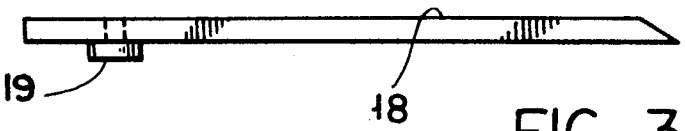
FIG. 3 PRIOR ART
FIG. 3 shows a side view of a rivetted plastic prior art doctor blade.

FIG. 3 shows another prior art doctor blade 18 made of a composite plastic material which at regular intervals is provided with a protruding rivet 19.

A doctor blade 20 constructed in accordance with the present invention and shown in FIGS. 4, 4A, 4B, 5 and 6 consists of a strip 22 a plastic material such as a fiber reinforced laminated plastic material having a plastic laminated base of, for example, a vinyl ester reinforced by fiberglass fibers. In a preferred embodiment of the invention, strip 22 is about 0.060 (1.5 mm) thick, and 3" (78 mm) wide. One side 24 of strip 22 is bevelled at an angle of about 45° to form a sharp doctoring edge 25. Adjacent to the other side 26 of the strip 22, there are a plurality of tabs or recesses 30 extending along the length of the strip. At least one end of the strip 22 is provided with a through hole 32 by which the strip can be grabbed so that it can be removed from a holder.

As shown in more detail in FIG. 4A, each recess 30 is formed by making two parallel cuts 34, 36 in the strip 22. Because the strip is made of fiber glass reinforced composite material, as described above, the cuts 34, 36 are not perfectly planar, but are somewhat irregular with the inner surfaces of the cuts having a plurality of irregular fibrillations 38 (shown in FIG. 6). (For the sake of clarity, in FIG. 4A the irregularities of cuts 34 and 36 are shown somewhat exaggerated).

Preferably, simultaneously with the cutting, the strap 40 is pushed out laterally with respect to the strip 22 to form the corresponding recess. The length and spacing of the cuts 34, 36 and their distance from side 26 are selected to insure that as the recess is formed the material around the cuts is deformed substantially, elastically, whereby the strip 22 is not permanently deformed. In this manner, the strap 40 is not broken off but remains attached to the strip at both ends to form the recesses. The strap 40 is retained in the position shown in FIG. 6 by the interference created between the irregularities or fibrillations on the surfaces formed by cuts 34, 36. Typically, each strap 40 may be, for example, about 1" (25 mm) long and 3/16" (4mm) wide, and may be disposed at least ⅛" (3mm) away from edge 26.

Figure 7:
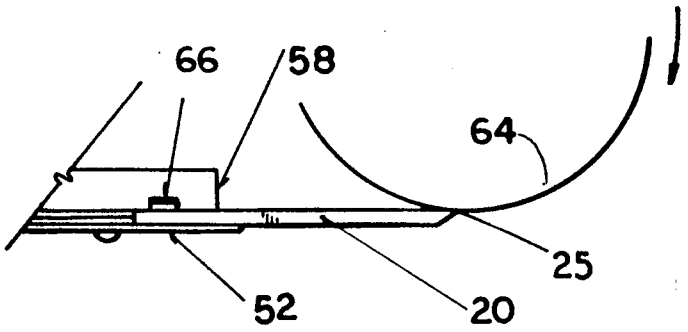
FIG. 7 shows a doctor blade constructed in accordance with this invention inserted into a blade holder.
Figure 8:
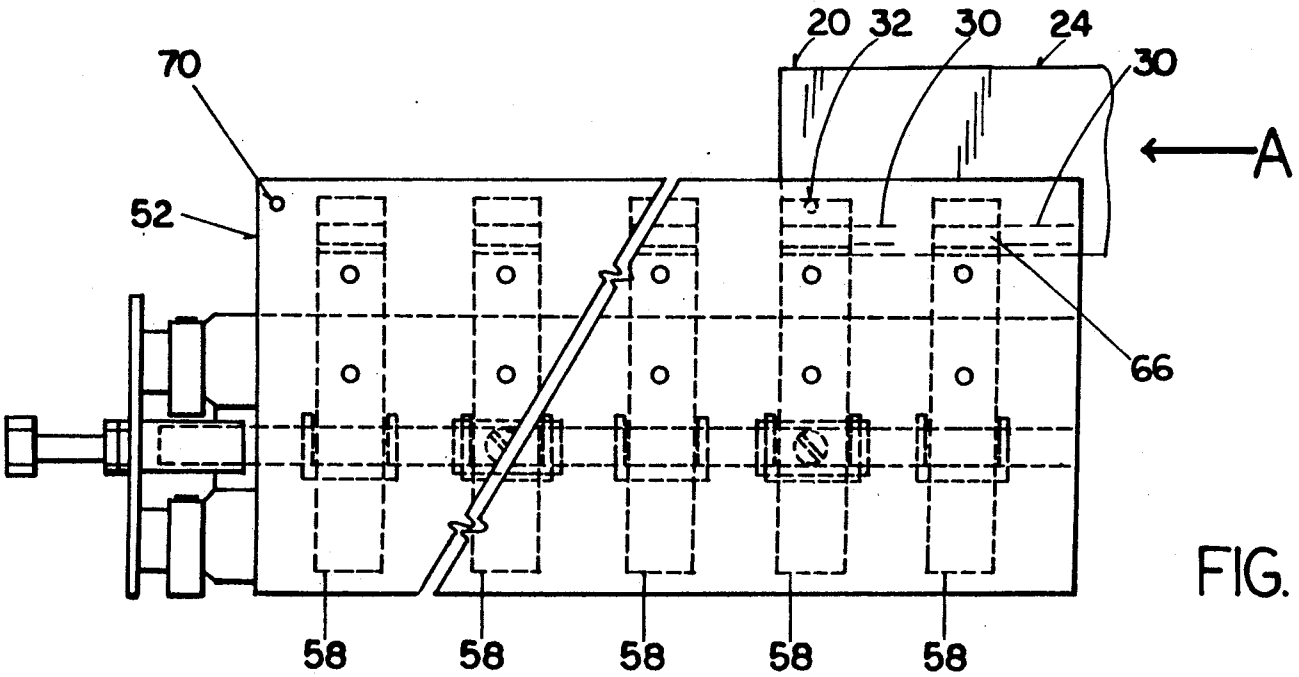
FIG. 8 shows a side view of the holder of FIG. 7 being inserted into the holder.

Referring now to FIGS. 7 and 8, a typical flexible doctor blade holder 50 consists of an elongated first member 52 secured to a frame (not shown). Several fingers 58 equally spaced along first member 52 as shown. Each finger 58 includes a channel 66. After blade 20 is formed as described above with reference to FIGS. 4–6, it may be inserted into the holder by sliding it into cavity 62 in direction A, with recesses 30 sliding through channel 66. A sharp tool may be used to engage hole 32 to pull the blade into the holder. The holder is made to have dimensions just slightly larger than the blade whereby, once the blade is seated in its place it is maintained there by interference fit with the holder. Additionally a hole 70 may be made at the ends of the holder. After the blade is inserted a pin is then introduced through hole 70, and hole 32 in the blade, thereby securing the blade in place. In FIG. 7 blade shown with edge 25 positioned for doctoring a roller 64.

The fingers 58 are spaced at a preselected distance of, for instance, 2 inches. For the embodiment of FIG. 8, in order to insure that at least some of the recesses 30 are captured between the fingers 58 and member 52, they are spaced at odd intervals, i.e. an odd number of inches.

Figure 8A:
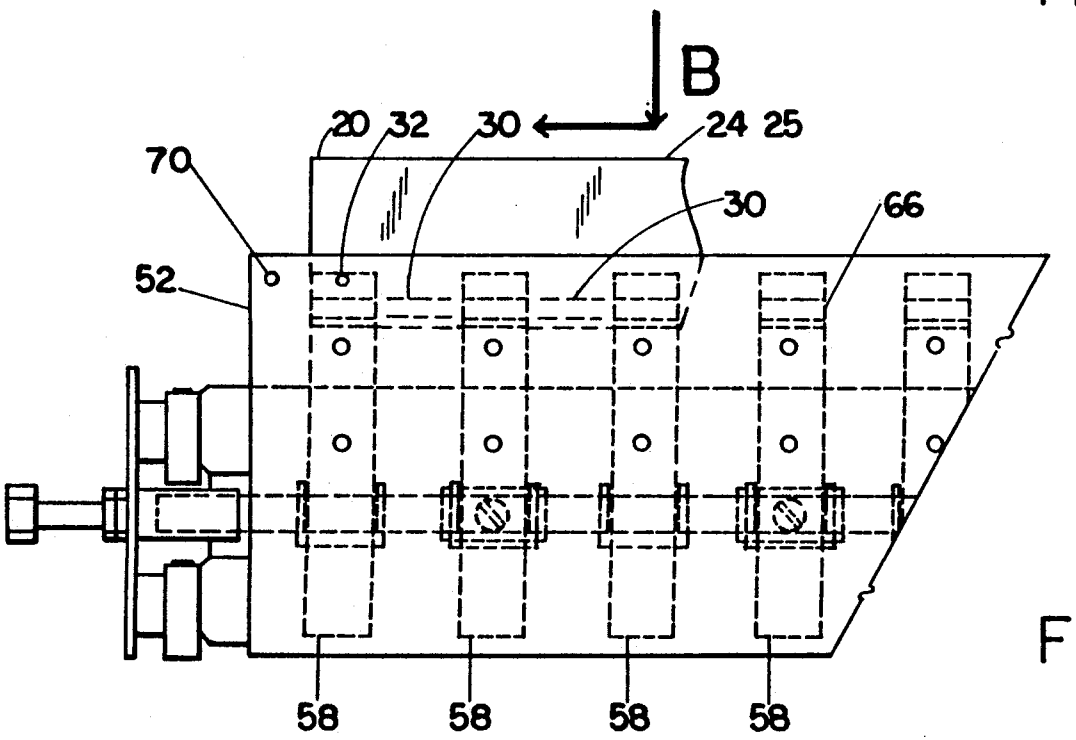
FIG. 8A shows an alternate embodiment for the holder and blade of FIG. 8.

In the preferred embodiment of FIG. 8A, the blade 20 is not inserted longitudinally. Instead the blade 20 is first positioned so each recess 30 is disposed between two fingers 58 and the blade is advanced laterally between plate 52 and fingers 58. The blade is then moved longitudinally, as indicated by arrow B until the recesses 30 are captured within channels 66 of fingers 58 and member 52. For this embodiment the recesses 30 must be spaced evenly with the spacing of the fingers 58. The blade may now be secured as described above. This embodiment is used in environments where there is insufficient lateral space to slide the blade longitudinally into the holder.

Figure 9:
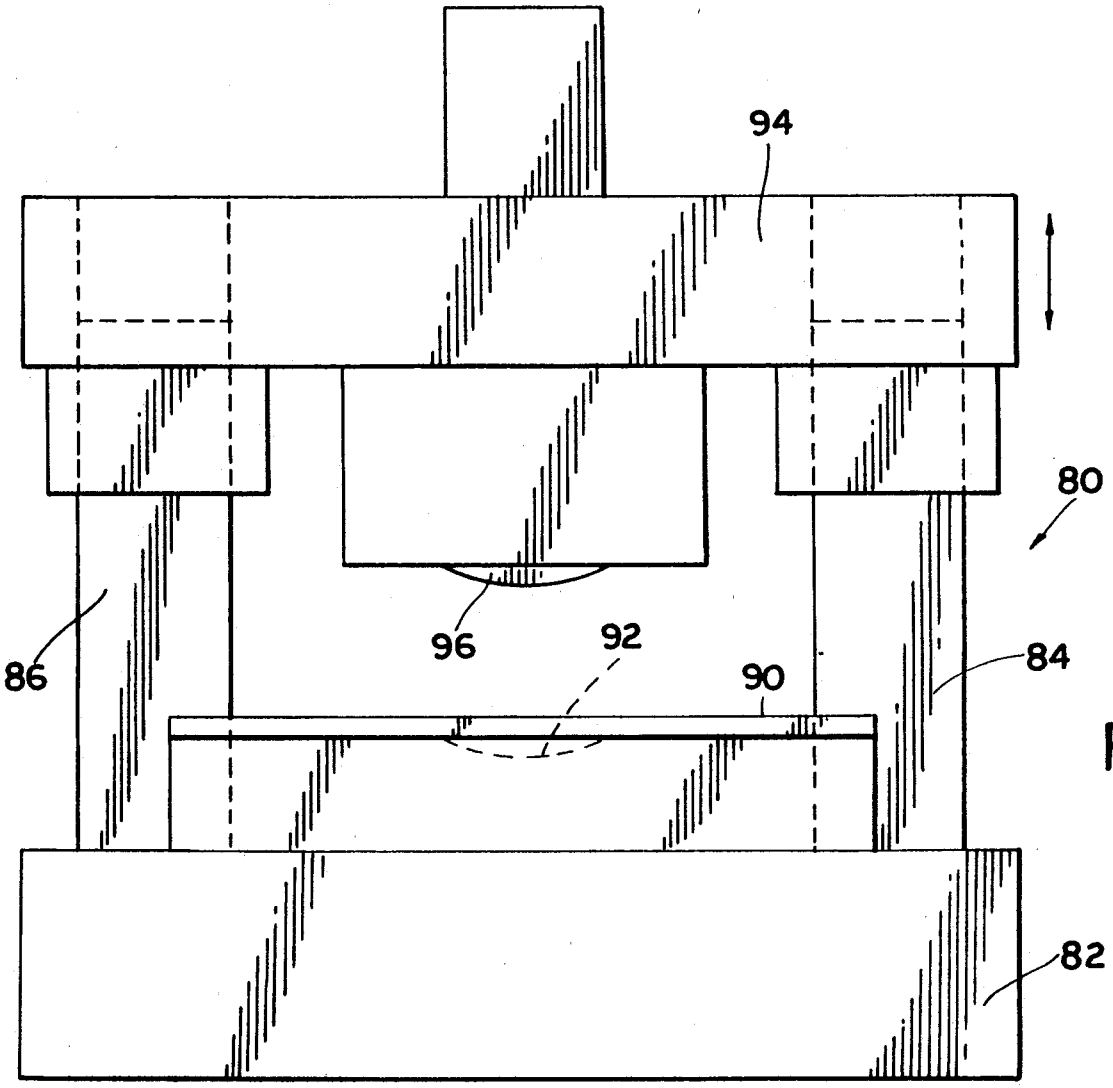
FIG. 9 shows a front view of a punch-and-die assembly used to punch the recess in the blade of FIGS. 4–8.
Figure 10:
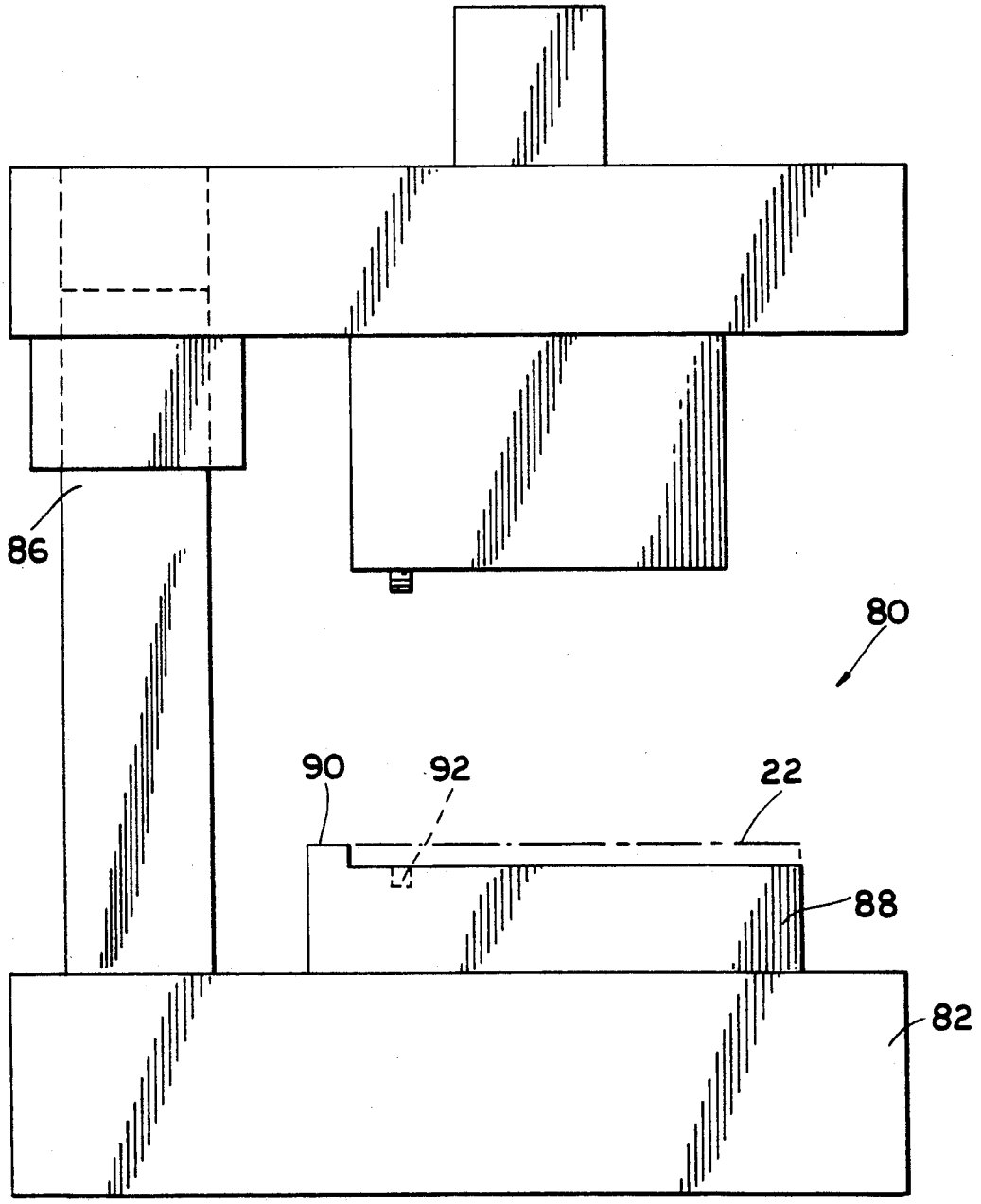
FIG. 10 shows an end view of the punch-and-die assembly of FIG. 9.

FIGS. 9 and 10 show a punch-and-die assembly 80 which may be used to make the recesses 30 in a strip 22. The assembly 80 includes a table 82 with two vertical uprights 84, 86. On table 82 there is a blade holder 88 for holding a blade 22. A lip 90 on holder 88 helps position the strip 22. The holder also has an arcuate depression 92 positioned at a distance from lip 90 to define the position and dimensions of the recesses. Above the table 82 there is a member 94 movable vertically on the uprights 84, 86 as shown. This member 94 has a lower extension 96 disposed exactly above depression 92 and dimensioned to be complementary in size and shape to the depression. Thus, without the strip 22, when the member 94 lowered on the holder 88, extension 96 fits snugly into depression 92.

The operation of assembly 80 is obvious from the above description. The strip 22 is first placed on holder 88 and then the member is forcefully lowered or dropped onto the strip 22. The shear formed at the interface between extension 96 and depression 92 generates the cuts 34, 36, and strap 40, and extension 96 pushes the strap 40 down to deform it elastically to form a recess. After each recess is made the strip is repositioned for the next recess by shifting it laterally. Alternatively the assembly 80 may be modified to make all the recesses simultaneously. Of course, other devices may be used to make the recesses as well.

Figure 11:
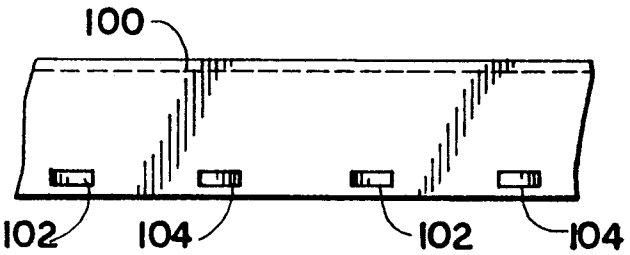
FIG. 11 shows a plan view of an alternate embodiment of the invention.
Figure 12:
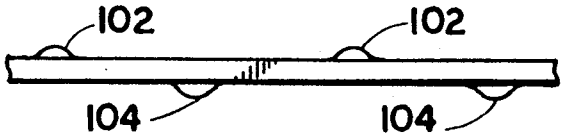
FIG. 12 shows a side view of the embodiment of FIG. 11.

An alternate embodiment of the invention is shown in FIGS. 11 and 12. In these Figures, strip 100 is made with two sets of recesses 102, 104 the difference between the two sets being that while recesses 102 are punched from the bottom, recesses 104 are punched from the top of strip 100 as shown. In the embodiment of FIGS. 11 and 12 the recesses 102, 104 are in line.

Figure 14:
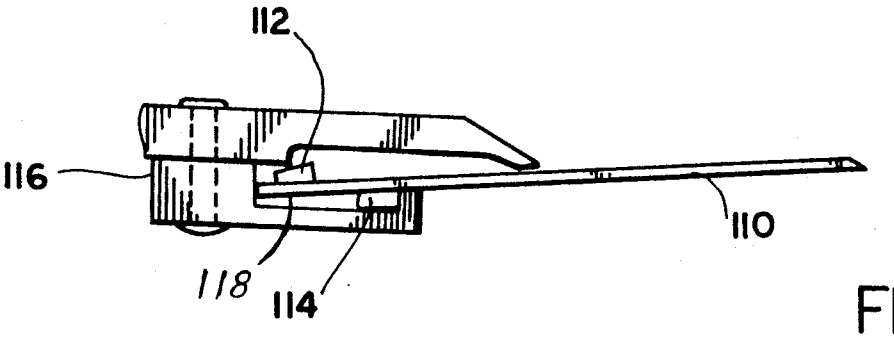
FIG. 14 shows a blade holder for the embodiment of FIG. 13.
Figure 13:
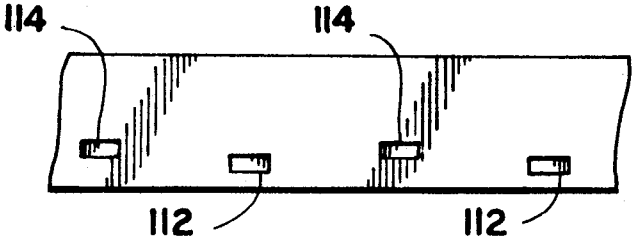
FIG. 13 shows a plan view of yet another alternate embodiment of the invention.

A further embodiment of the invention is shown in FIG. 13 wherein strip 110 is also formed with two sets of recesses 112, 114. However in this latter embodiment recesses 112 are laterally offset from recesses 114. A holder 116 for a doctor blade made like strip 110 is shown in FIG. 14. In this Figure, the holder 116 is made with a much wider channel 118 to accommodate both recesses 112, and 114 as shown.

Figure 15:
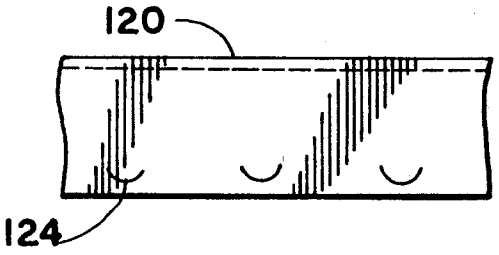
FIG. 15 shows yet a further embodiment of the invention.

Finally, the recesses may be formed by means other than two parallel cuts. For example as shown in the embodiment of FIG. 15, a blade 120 may be made with recesses 122 formed by a single curve, dimensioned and shaped to cut out sufficient material to allow elastic deformation. As previously described, the recess will hold in place because of the fibrillation of the material along the curved cut.

Similarly, numerous other modifications may be made to the invention without departing from its scope as defined in the appended claims.

We claim:

1. A doctor blade comprising:

an elongated strip having a first side, a second side, and a surface extending therebetween; and a plurality of tabs deformed elastically on said strip; said tabs and said strip having irregularities formed in said material when said material is sheared along a plane generally normal to said surface to generate said tabs, said irregularities forming an interference between said tabs and said strip to maintain said tabs at least partially above said surface.

2. A doctor blade comprising:

an elongated strip made of a plastic material, and having first and second sides, and first and second surfaces extending between said first and second sides, said material forming fibrous protrusions generally normal to at least one of the first and second sides when sheared along a plane substantially normal to the first and second surfaces; and a plurality of tab means formed on said strip and extending above one of said first and second surfaces to extend the effective thickness of the blade, said tab means being formed of said material and maintained in place by said fibrous protrusions.

3. The doctor blade assembly of claim 2 wherein said material is a plastic composite material.

4. The doctor blade assembly of claim 2 wherein said plurality of tab means are partitioned into a first group of tab means and a second group of tab means, said first group protruding above said first surface, and said second group of tab means protruding below said second surface.

5. The doctor blade assembly of claim 4 wherein the tab means of said first group alternate with tab means from said second group.

6. The doctor blade of claim 3 wherein each tab means includes a strap, said strap is formed by a pair of parallel cuts in said strip, each cut defining interfacing surfaces, said interfacing surfaces having protrusions which maintain said strip laterally offset from said strip.

7. The doctor blade of claim 6 wherein said strip is formed of a reinforced composite material.

8. The doctor blade of claim 6 wherein said material is made of a plastic material reinforced with fiberglass fibers.

9. The doctor blade of claim 8 wherein said plastic material is a laminated vinyl ester.

10. The doctor blade of claim 2 wherein said tab means are defined by straight edges separating said tab means from said strip.

11. The doctor blade of claim 2 wherein said tab means are defined by curved edges separating said tab means from said strip.

12. A doctor blade assembly comprising:

a. doctor blade holder means consisting of an elongated member having a longitudinal cavity; and b. a doctor blade formed of an elongated strip made of a reinforced composite plastic material, said blade having first and second opposite sides, a surface therebetween, and a plurality of tabs formed near one of said sides from said material, said tabs being maintained in place by a plurality of fibrous protrusions disposed at the interface between said tabs and said surface, said fibrous protrusions being formed from said material when said material is sheared along a plane substantially normal to said surface, and said tabs extending above said surface to increase the effective thickness of said blade, said blade being coupled to said holder with said tabs cooperating to capture said blade.

13. The doctor blade assembly of claim 12 wherein said tabs consist of a strap of the same material as said strip.

14. The doctor blade assembly of claim 12 wherein said strip has first and second opposed surfaces, and said tabs protrude above one of said surfaces.

15. The doctor blade assembly of claim 14 wherein said plurality of tabs are partitioned into a first group of tabs and a second group of tabs, said first group protruding above said first surface, and said second group of tabs protruding below said second surface.

16. The doctor blade assembly of claim 15 wherein the tabs of said first group alternate with tabs from said second group.

17. The doctor blade assembly of claim 12 further comprising securing means for securing said blade to said holder.

* * * * *